US005424517A

United States Patent [19]

Habeger, Jr. et al.

[11] Patent Number: 5,424,517

[45] Date of Patent: Jun. 13, 1995

[54] MICROWAVE IMPEDANCE MATCHING FILM FOR MICROWAVE COOKING

[75] Inventors: Charles C. Habeger, Jr., Appleton, Wis.; Kenneth A. Pollart, Mason, Ohio; Karl Josephy, Los Angeles, Calif.; James P. Rettker, Glenwood, Ill.; Richard M. Thomas, Dyer, Ind.

[73] Assignee: James River Paper Company, Inc., Milford, Ohio

[21] Appl. No.: 141,724

[22] Filed: Oct. 27, 1993

[51] Int. Cl.[6] ..... H05B 6/80

[52] U.S. Cl. ..... 219/728; 219/729; 426/107; 426/234; 426/243; 99/DIG. 14

[58] Field of Search ..... 219/728, 729, 730, 759; 426/107, 109, 234, 241, 243; 99/DIG. 14

[56] References Cited

U.S. PATENT DOCUMENTS

| | | | |
|---|---|---|---|
| 2,820,127 | 1/1958 | Argento et al. | 219/728 |
| 3,219,460 | 11/1965 | Brown | 219/729 |
| 3,302,632 | 2/1967 | Fichtner | 219/730 |
| 4,266,108 | 5/1981 | Anderson et al. | 219/730 |
| 4,640,280 | 2/1987 | Sterzer | 219/10.55 F |
| 4,641,005 | 2/1987 | Seiferth | 219/730 |
| 4,656,325 | 4/1987 | Keefer | 219/728 |
| 4,866,234 | 9/1989 | Keefer | 219/728 |
| 4,876,423 | 10/1989 | Tighe et al. | 219/730 |
| 4,888,459 | 12/1989 | Keefer | 219/728 |
| 4,927,991 | 5/1990 | Wendt et al. | 219/728 |
| 4,959,516 | 9/1990 | Tighe et al. | 219/730 |
| 4,972,058 | 11/1990 | Benson et al. | 219/730 |
| 5,126,518 | 6/1992 | Beckett | 219/729 |
| 5,126,520 | 6/1992 | Nottingham et al. | 219/729 |

FOREIGN PATENT DOCUMENTS

| | | | |
|---|---|---|---|
| WO92/08565 | 5/1992 | WIPO | 219/728 |

*Primary Examiner*—Philip H. Leung

*Attorney, Agent, or Firm*—Sixbey, Friedman, Leedom & Ferguson

[57] ABSTRACT

A food package including a package body forming a food receiving cavity for storing and heating a food item in a microwave oven. Specifically, the package body includes a bottom panel and a top panel with side panels joining the bottom and top panel. An impedance matching element is provided on at least one of the panels for impedance matching microwave energy entering the package. The impedance matching element is preferably a contiguous film of thinly flaked material embedded in a dielectric binder which is sized and shaped with respect to the food to cause impedance matching to elevate the temperature of the food in predetermined areas dependent upon the size and spacing of the film without interacting with the microwave energy to produce heat. The film may also be shaped in the form of a convex lens to direct impedance matched microwave energy toward the food to elevate the temperature of the food in a predetermined area. Further, the flake material may be present in the binder in an amount sufficient to provide microwave shielding.

46 Claims, 12 Drawing Sheets

MICROWAVE IMPEDANCE MATCHING FILM FOR MICROWAVE COOKING

BACKGROUND OF THE INVENTION

1. Technical Field of the Invention

The present invention relates to microwave cooking of a food item. More particularly, the present invention relates to microwave food packages which include means for impedance matching microwave energy in a microwave oven to more evenly distribute microwave energy within a food item without interacting with the microwave energy to produce heat.

2. Description of the Prior Art

The popularity of microwave ovens for cooking all or part of a meal has led to the development of a large number of food packages capable of cooking a food item in a microwave oven directly in the food package in which it is stored. The convenience of cooking food in its own package or a component thereof appeals to a large number of consumers. However, one dissatisfaction of microwave cooking for some foods is the inability to heat or warm the center of the food without burning or severely dehydrating the exterior thereof. In particular, larger servings are very difficult to heat uniformly using conventional food packages in a microwave oven. Even when the outer portions are thoroughly cooked, the center is generally undesirably cool.

Microwave interactive films have been produced which are capable of generating heat at the food surface to crispen some food products. U.S. Pat. No. 4,641,005, issued to Seiferth and assigned to James River Corporation of Virginia, assignee of the present application, discloses a microwave interactive material useful in food packaging which is capable of browning the surface of a food item. Specifically, the interactive material includes a very thin metal film applied to a polymer material which is adhered to a rigid substrate. Such a film actually interacts with microwave energy to produce heat at the surface of the food. The heat provided by such an interactive material is advantageous for browning the surface of a food item, but is not advantageous for cooking a thick food item having a large dielectric constant because the outer portion of the food will cook even faster than without interactive material resulting in a deficiently heated inner portion.

Additional microwave heating devices have also been developed primarily for use in food packaging. U.S. Pat. No. 4,876,423, issued to Tighe et al., discloses a medium for producing localized microwave radiation heating wherein the medium is formed from a mixture of polymeric binder and conductive and semiconductive particles that can be coated or printed on a substrate. Again, however, such a medium is designed to interact with the electromagnetic, microwave energy to produce heat and thereby, brown or crispen the surface of a food item, while providing no enhanced heating of the center of the food.

A number of microwave food packages or containers have also been developed which are designed to uniformly heat or adjust the reflectance, transmittance, or absorbance of microwave energy. U.S. Pat. No. 4,266,108 to Anderson et al. discloses a microwave heating device which includes both a microwave reflective member and a microwave absorbing member spaced apart a distance sufficient to provide a temperature self-limiting device. As provided in the above-noted patents, however, the device includes a heater member which interacts with the microwave energy to produce heat and, thus, conductively heats the food item.

Further, U.S. Pat. No. 4,927,991 to Wendt et al. is directed to a food package which discloses a susceptor or heater element in combination with a grid wherein the susceptor surface may be tuned to a matched impedance for maximum microwave power absorbance. Specifically, the reflectance, transmittance and absorbance of the heater can be adjusted by changing certain design factors, including the grid hole size, the susceptor impedance, the grid geometry, the spacing between the grid and the susceptor and the spacing between adjacent holes. The food items contemplated for cooking in such a package is similar to those noted above, particularly food items which require some amount of surface browning or crisping, such as pizza, fish sticks or french fries. Moreover, the problem of adequately heating the center of these types of foods is not required by this device, due to their relatively thin overall nature.

Containers have been also developed which include specially designed covers or lids which are capable of modifying microwave field patterns and which may undergo a change in dielectric constant during microwave heating thereof to alter the heating distribution within the container as heating proceeds. U.S. Pat. No. 4,888,459, issued to Keefer, discloses a microwave container which includes a dielectric structure to provide these properties. Specifically, Keefer discloses a container which may include a lid having a single or a plurality of metal plates or sheets located thereon. A higher electrically thick region may be formed from a dispersion of metal particles in a matrix wherein the dielectric constant of the higher electrical portion is disclosed to be in the range of 25 to 30 for a nonlimiting region. Further, the region may be lossy in character which allows the region, at least initially, to be microwave absorptive, and thus, heat up when exposed to microwave energy. In addition, the region of greater electrical thickness may actually undergo a decrease in dielectric constant during the coarse of microwave heating. Unfortunately, the region or regions of greater electric thickness disclosed by Keefer in this reference and a related U.S. Pat. No. 4,866,234 are at least partially interactive with microwave energy. As a result, the region will produce heat during microwave cooking which may not be desired for certain food items, such as pot pies or fruit pies. Furthermore, without the "shut-off" feature, the production of heat may also create a scorching or fire hazard for food items which require an extended cooking time.

Keefer also discloses in U.S. Pat. No. 4,656,325 a microwave heating package which includes a cover arrangement for use with microwave reflective foodstuff holding pans, such as aluminum foil pans. The cover is compared to a non-reflective coating in optics because it permits microwave radiation into the container holding the foodstuff, while substantially preventing escape of microwave radiation reflected from the foodstuff surface and the container bottom to thereby trap or concentrate the energy within the container. The cover disclosed in the '325 patent is designed to provide, among other things, browning and/or crisping of the surface of the foodstuff.

Food wraps have also been developed for surface heating a food item with variable microwave transmission. U.S. Pat. No. 4,972,058 to Benson et al. discloses a composite material for the generation of heat by absorption of microwave energy comprising a porous dielectric substrate and a coating including a dielectric matrix and flakes of microwave susceptive material. The aspect ratio of the flakes is at least 10. The flake material used in the composite material disclosed by Benson et al. is limited, however, to jagged edged metal flakes.

Consequently, a microwave package is needed which includes a means for uniformly and evenly elevating the temperature of a food item, particularly a food item having a high dielectric constant. Specifically, a microwave package element having a high dielectric constant which does not interact with microwave energy to produce heat and is capable of elevating the temperature of a food item in predetermined areas dependent upon the size and shape of the element is needed for thick food items.

SUMMARY OF THE INVENTION

Therefore, a primary object of the present invention is to overcome the deficiencies of the prior art, as described above, and specifically, to provide a package for storing and microwave heating food which elevates the temperature of a food item without directly dissipating the microwave energy to heat.

Another object of the present invention is to provide a package which includes a means for impedance matching microwave energy entering the package to uniformly elevate the temperature of a food item held within the package, including the center of the food item, wherein the means for impedance matching does not interact with the microwave energy to produce heat.

Yet another object of the present invention is to provide a package for storing and microwave heating a food item including an impedance matching means provided on a portion of the package for impedance matching microwave energy entering the package wherein the impedance matching means comprises a contiguous film of thinly flaked material embedded in a dielectric binder which is capable of elevating the temperature of a predetermined area of a food item without interacting with the microwave energy to produce heat.

The foregoing objects are achieved by providing a package including a package body forming a food receiving cavity. Specifically, the package body includes a bottom panel and a top panel with side panels joining the bottom and top panel. An impedance matching element is provided on at least one of the panels for impedance matching microwave energy entering the package. The impedance matching element is preferably a contiguous film of thinly flaked material embedded in a dielectric binder which is sized and shaped with respect to the food to cause impedance matching to elevate the temperature of the food in predetermined areas dependent upon the size and spacing of the film without interacting with the microwave energy to produce heat. As a result, the center of a thick food item, such as a pot pie, may be thoroughly heated without scorching or overheating the exterior portions thereof.

DETAILED DESCRIPTION OF THE INVENTION

Microwave cooking of some foods has not been commercially acceptable by consumers for all cooking needs because many thick foods, such as large pot pies or fruit pies, cook faster on the edges than in the middle. The present invention provides a cooking means and food package including the same which impedance matches microwave energy to effectively couple the microwave energy into specific areas of a food item and, thereby, increase the temperature of these areas that normally heat up slowly. Through mathematical analysis, it was determined that the impedance matching means of the present invention is more pronounced on loads with higher dielectric constants and the optimum separation for impedance matching decreases with dielectric constant, but only very little. Impedance matching is accomplished by utilizing a film spaced between a food item and incoming microwave radiation. The presence of the impedance matching film increases the amount of microwave energy directly transferred to the food.

Figure 1:
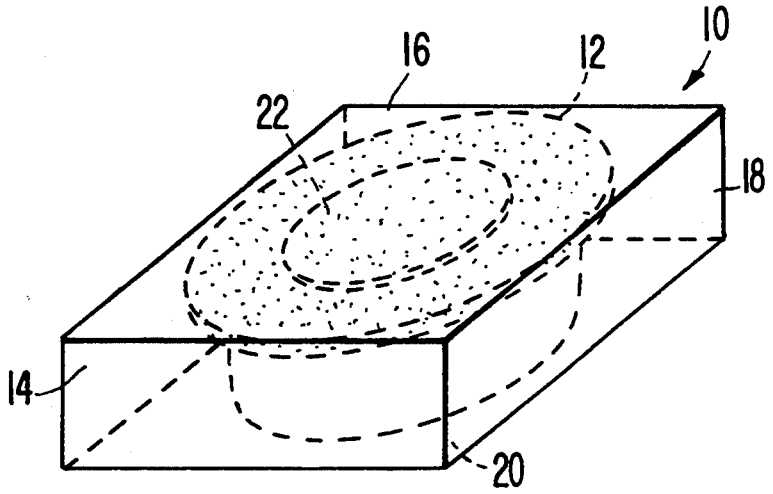
FIG. 1 is a food package including a microwave impedance matching element of the present invention.

For a clearer understanding of the present invention, attention is initially directed to FIG. 1. Specifically, FIG. 1 illustrates a food package 10. Food package 10 contains a food item 12, shown as a pot pie, within food receiving space 14. A number of additional food items such as fruit pies and stews could also be effectively heated by a package made in accordance with the present invention.

Food package 10 includes a top panel 16, side panels 18 and bottom panel 20 which form food receiving space 14 which is substantially transparent to microwave energy and may be constructed from a variety of microwave transparent materials. Preferably, the food package is made from paper or paperboard, but may also be fabricated from a microwave compatible plastic material. Impedance matching member 22 is preferably positioned on top panel 16 over food item 12. By positioning impedance matching member 22 over food item 12, as shown in FIG. 1, the microwave energy entering package 10 is impedance matched by member 22 to effectively distribute microwave energy into the center of food item 12 wherein member 22 does not interact with the microwave energy to produce heat. As a result, member 22 is not a heater in the conventional sense, but instead provides a novel means for effectively raising the temperature of the interior of a food item by impedance matching the incident microwave energy acting on the food.

Figure 2A:
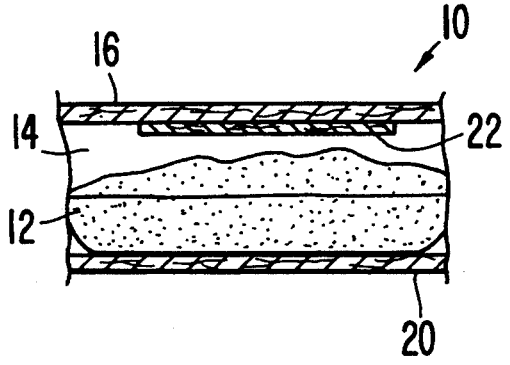
FIG. 2A is an exploded cross-sectional view of the package of FIG. 1 taken along lines 2—2.

FIG. 2A clearly shows impedance matching member 22 positioned on the interior surface of top panel 16 over food item 12. Preferably, impedance matching member 22 is positioned from $\frac{1}{8}$" to $\frac{5}{8}$" above the surface of food item 12. Impedance matching member 22 may be printed or coated directly onto container 10 or it may be previously applied to a separate substrate. The substrate may be paperboard, paper, polyester film or any other microwave transparent material capable of carrying impedance matching member 22.

Figure 2B:
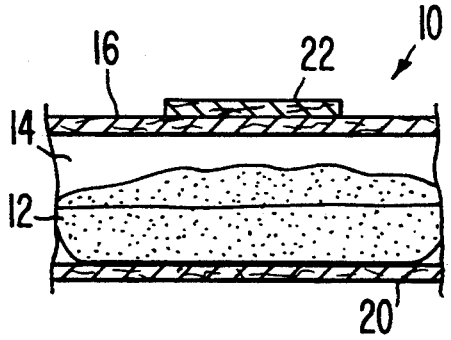
FIG. 2B is an exploded cross-sectional view of a second embodiment of the package of FIG. 1.
Figure 2C:
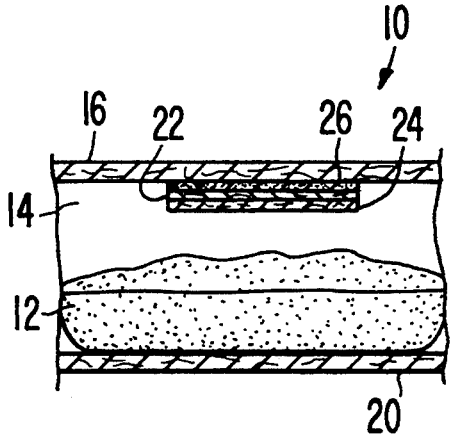
FIG. 2C is an exploded cross-sectional view of a third embodiment of the package of FIG. 1.
Figure 2D:
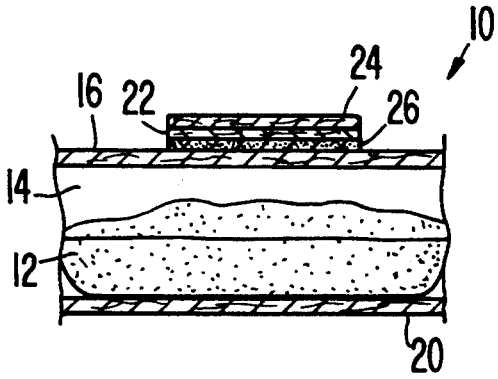
FIG. 2D is an exploded cross-sectional view of a fourth embodiment of the package of FIG. 1.

Food package 10 may also be designed in a number of additional configurations, some of which are illustrated in FIGS. 2B–2H. Specifically, FIG. 2B shows package 10 having impedance matching member located on the outside of the package on top panel 16. In addition, impedance matching member 22 may also be placed between different materials. For instance, FIGS. 2C and 2D illustrate impedance matching member 22 positioned between a substrate 24 and an adhesive layer 26 used to laminate the impedance matching member to the top panel 16 of food package 10. Substrate 24 may be paper, paperboard, or film upon which impedance matching member 22 may be printed or coated.

Figure 2E:
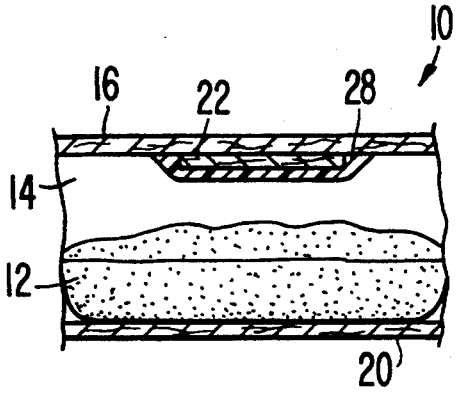
FIG. 2E is an exploded cross-sectional view of a fifth embodiment of the package of FIG. 1.
Figure 2F:
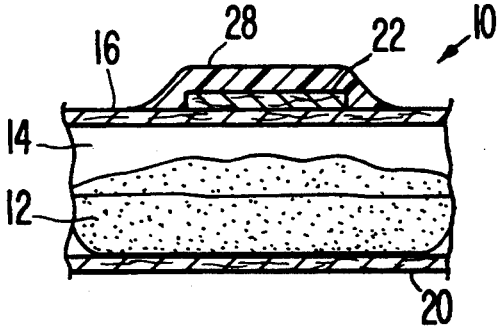
FIG. 2F is an exploded cross-sectional view of a sixth embodiment of the package of FIG. 1.
Figure 2G:
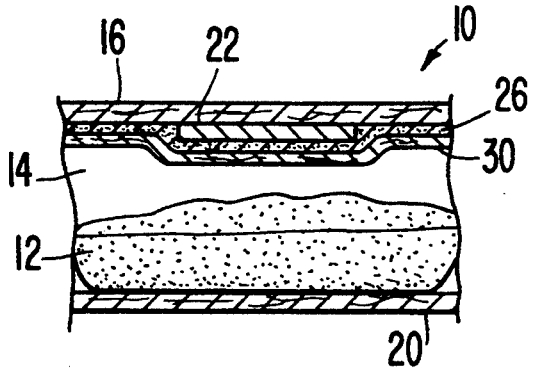
FIG. 2G is an exploded cross-sectional view of a seventh embodiment of the package of FIG. 1.
Figure 2H:
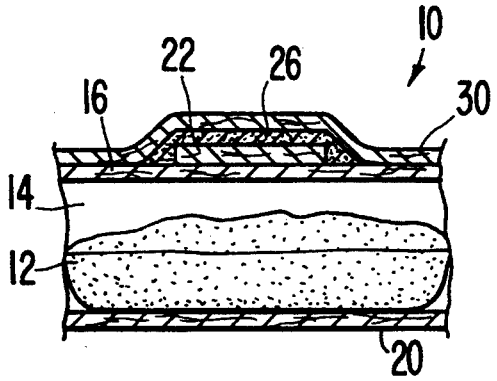
FIG. 2H is an exploded cross-sectional view of a eighth embodiment of the package of FIG. 1.

FIGS. 2E and 2F illustrate additional embodiments in which impedance matching member 22 is embedded or surrounded by a film 28 of resin or ink applied to the surface by a conventional printing process, for example. Further, impedance matching member 22 can be sandwiched by a material 30, such as paper, paperboard, or plastic, which is adhered to a surface by an adhesive layer 26, as illustrated in FIGS. 2G and 2H. These embodiments are but a few of the many package configurations possible which utilize impedance matching member 22.

Figure 3:
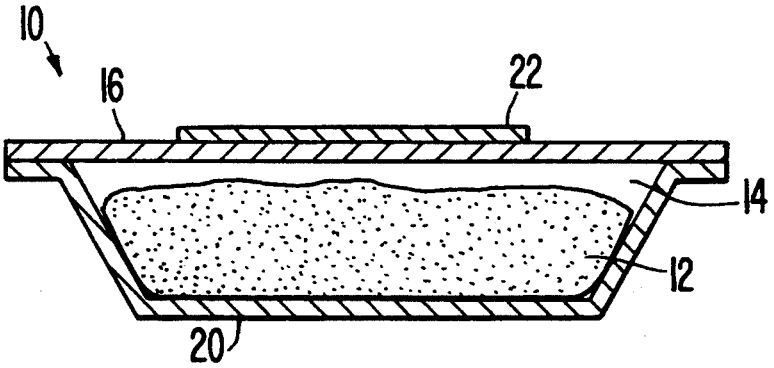
FIG. 3 is a cross-sectional view of another embodiment of a food package including a microwave impedance matching element of the present invention.

FIG. 3 illustrates yet another possible package configuration 10 wherein impedance matching member 22 is located on a lid of a food tray, rather than on a separate carton, as shown in FIGS. 1 and 2A–2H.

Impedance matching member 22 comprises a film of thinly flaked material embedded or held within a dielectric binder material. Preferably, impedance matching member 22 is shaped to be diametrically smaller than food item 12. The dielectric binder may be chosen from a variety of commercially available binder materials, for example silicone or acrylic binders.

Specifically, the preferred dielectric binder is a low loss tangent, high dielectric constant, and high dielectric strength material (all measured at 2.45 GHz). Low loss silicone binders, such as Dow Corning TM 1-2577, and some acrylics, such as the styrene/acrylic Joncryl 611 from Johnson Wax TM, may be utilized to provide coatings with the desired impedance matching response without producing detrimental heat in the presence of microwave energy. On the other hand, if a resin with a high loss tangent, such a nitrocellulose, is utilized as the binder material, the resultant impedance matching coating will undergo excessive heating when exposed to microwave energy resulting in a variety of undesirable side effects, such as scorching or melting of the coating substrate.

The thinly flaked material of the present invention is essential to achieving advantageous results. The flakes are generally flat and planar and made from a metallic material. It is important that the flake have a length which allows it to lay substantially flat in the binder material. At the same time, the flake should be at a length which allows it to be printed onto a substrate by a conventional printing process, such as gravure printing. Generally, the desired flakes are aluminum metal having an average longest dimension within the range of approximately 8–75 micrometers (μm) and a smaller dimension or width in the range of 5–35 μm. Preferably, the longest dimension is within the range of 10–30 μm. Although aluminum metal is preferred, other metal materials may be equally applicable to the present invention.

Figure 4A:
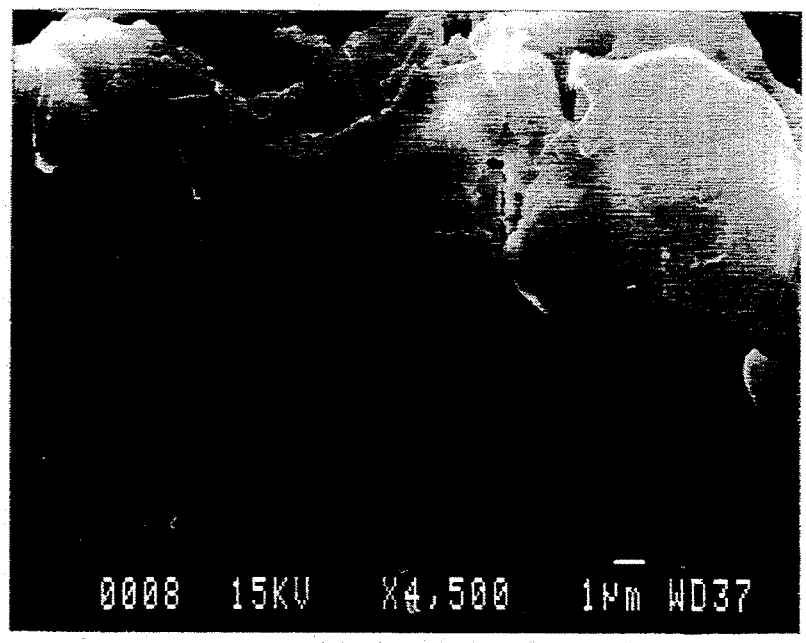
FIG. 4A–4B are enhanced microscopic views of the aluminum flake of the present invention.
Figure 4B:
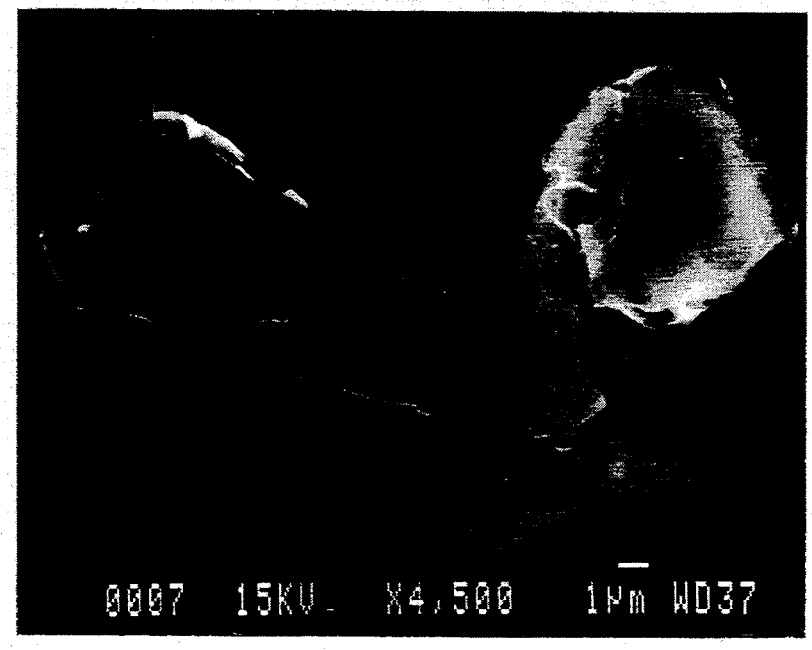

Referring to FIGS. 4A and 4B, the preferred flakes of the present invention are shown under magnification. As can be seen, the flakes themselves appear to have a substantially smooth perimeter with a limited number of fragmented flakes present in the binder. The apparent smoothness of a flake may depend upon the degree of magnification. However, describing the flake perimeter as smooth can be defined by comparing it to a flake having a jagged perimeter. Specifically, the smoothness of the perimeter of the flake can be contrasted with a flake which is jagged to the extent that a jagged flake includes a multiplicity of intersecting straight lines to form angles less than 180°. The smooth perimeter of the flake provides a lesser total parametric length than a jagged perimeter. FIGS. 5A–5C and 6A–6C illustrate prior art metal flakes. It is clear by comparing the flakes shown in FIGS. 5A–5C and 6A–6C with those shown in FIGS. 4A and 4B that the flakes shown in FIGS. 4A and 4B have a smaller parametric length.

In addition to length, the thickness of the flake material is also important in obtaining the advantageous features of the present invention. The flake should have a sufficient thickness to maintain flake dimensional integrity and sufficient mechanical strength to endure dispersion in the binder material. On the other hand, the flake material should not be so thick that it no longer is capable of providing close packing between adjacent flakes. Preferably, the flakes have a thickness within the range of 100–500 Å. More preferably, the flake has a thickness within the range of about 100–200 Å. If the flake material is made of aluminum metal, the preferred aluminum flake is made from aluminum metal by vapor deposition and the thickness should provide an optical density within the range of 1–4.

The flake material, also, preferably has an aspect ratio of at least 1000. Such an aspect ratio provides an impedance matching member 22 having an effective dielectric constant of at least 4,000. At such a high dielectric constant, a thin impedance matching member 22 is capable of matching the impedance of the microwave energy present in a microwave oven and in so doing direct the microwave energy more effectively into the interior of the food item held within the package below the impedance matching member 22.

When these flakes are slurried in a dielectric binder and printed, the flakes form an archipelago of flat conductive islands that are almost in contact at many locations to form impedance matching member 22. This concentrates the electric fields in the regions between the flakes and greatly increases the amount of electrical energy that is stored. Impedance matching member 22 formed in this manner is for all intents and purposes a non-conductive film with a very high dielectric constant.

A quantitative representation of the films potency for impedance matching is expressed in terms of a single dimensionless film parameter, x. Such a representation may be helpful in understanding the advantageous results substantiated below. Specifically, for resistive and capacitive films, the x's are defined as follows:

$$x=\sigma d Z_o/2 \text{ (resistive film)} \quad (1)$$

$$x=\pi i f \epsilon_r \epsilon_o Z_o d \text{ (capacitive film)} \quad (2)$$

In these equations, $Z_o$ is the free-space impedance of the radiation as projected to the plane of the film, a is the bulk conductivity of the resistive film, d is the film thickness, i is the square root of negative one (imaginary), f is the frequency, $\epsilon_o$ is the permittivity of free space (generally, equal to $8.85\times10^{-12}$ Farads/meter), and $\epsilon_r$ is the complex, relative dielectric constant of the capacitive film.

Again returning to a mathematical representation of the impedance matching member of the present invention, when a film of infinite extent is immersed in free space, the reflection coefficient, R, and transmission coefficient, T, for resistive and capacitive films are:

$$R=-x/(1+x) \quad (3)$$

$$T=1/(1+x) \quad (4)$$

For a resistive film, x is real, T is in phase with the incoming radiation, R is 180° out of phase, and the absolute values of R and T sum to one. Since x is a complex number for the capacitive film, the phase of R and T depends on the magnitude of x and the phase of $\epsilon_r$. When summed as complex numbers, T still equals 1+R, but the sum of the absolute values of T and R becomes greater than one. Since no energy is dissipated in a perfect dielectric, a capacitive film with the same reflection amplitude as a resistive film transmits more radiation. It should be understood that, in the discussion below, the x-value for capacitive films are complex.

The portion of incident power dissipated in a resistive film is:

$$A_r=2x/(1+x)^2 \quad (5)$$

while in the capacitive film, the power dissipated is:

$$A_c=2|x|\sin\delta/(1+|x|^2+2|x|\sin\delta) \quad (6)$$

where $\delta$ is the loss angle of the dielectric. It should be noted that a resistive film has a peak absorption of 0.5 at x=1, and a capacitive film has a peak absorption of $\sin\delta/(1+\sin\delta)$ at $|x|=1$. A perfect dielectric ($\sin\delta=0$) has no absorption for any magnitude of x. It should also be noted that these equations are only applicable to thin films, meaning the thickness of the film should be much less than the wavelength of radiation in the film.

Power distribution in thin film radiation may be calculated with simple electrical networks. The incoming radiation is represented as source with an output impedance of free space ($Z_o$), the film is a resistor or capacitor to ground having a value of $Z_o/2x$ and the space behind the film is another $Z_o$ resistor to ground. When the free space backing is replaced with a dielectric, such as food stuff, the second $Z_o$ must be replaced with the impedance of the dielectric ($Z_d$). Since the ratio of $Z_d$ to $Z_o$ is $1/\epsilon_r^{\frac{1}{2}}$ for normally incident radiation, a simple circuit representation will yield a transmission coefficient into a dielectric with a capacitive film coating to be:

$$T=2/(1+2x+\epsilon_r^{\frac{1}{2}}) \quad (7)$$

For a resistive film, x is real so T decrease monotonically with x. If the dielectric is lossy, $\epsilon_r$ has a negative imaginary component. Therefore, as $|x|$ initially increases for capacitive films (x imaginary), the x term starts to cancel the imaginary part of $\epsilon_r$, and T actually increases. Eventually, x will dominate $\epsilon_r$ and T will drop, but for a while, the capacitive film improves the impedance match of lossy foods and, as a result, increases the energy input thereto. Once T is known, the portion of the energy transmitted into a dielectric food load can be calculated as the real part of $\epsilon_r^{\frac{1}{2}}TT^*$, where $T^*$ is the complex conjugant of T.

If the impedance matching film of the present invention is separated by a distance L, the absorption of microwave energy by the food item can be greatly increased. Using the transmission line impedance equation to transfer the impedance of the dielectric a distance L through free space to the film, $Z_d$ can be replaced by $Z_d$, as a function of L, to give:

$$\frac{Z_d(L)}{Z_o}=\frac{[1+\epsilon_r^{\frac{1}{2}}i\tan(k_oL)]}{[\epsilon_r^{\frac{1}{2}}+i\tan(k_oL)]} \quad (8)$$

where $k_o$ is the wave number in free space which equals $2\pi f(\epsilon_o\mu_o)^{\frac{1}{2}}$ and $\mu_o$ is equal to $4\pi\times10^{-7}$ henry/meter. By replacing $Z_d/Z_o$ from Equation (8) in Equation (7) for $1/\epsilon^{\frac{1}{2}}$, it has been found that at film-dielectric separations of integer half wavelengths, the capacitive films can shield quite well. With separations of about 1 cm (plus integer half wavelengths) and x's of about 1.0 i (or a dielectric constant times thickness for normal radiation at 2.45 GHz of about 0.04 meters), near total absorption may be realized in an infinite load.

Using the circuit model explained above, the effective load of the film and a load, for example water, is the parallel combination of the film and the load transferred to the film. Therefore, the inverse of the effective load is the sum of the inverses of the film impedance and the transferred impedance of the load. When eqn. (8) is used to transfer an impedance (Z) as a function of L, the impedance normalized to $Z_o$ (and its inverse) trace out a circle in the complex impedance plane that cuts the real axis at $|Z|/Z_o$ and $Z_o/|Z|$.

At some place along the curve, i.e. at some separation, L, the inverse of the normalized impedance will be 1.0 plus some positive imaginary number, Ni. If a film is chosen where x equals i/N, then the inverse of x is −Ni and the total impedance is $Z_o$ which would be a perfect impedance match with no energy reflected. Since the capacitive film of the present invention does not absorb, all the energy ends up as heat in the load. For this reason, it is very effective for heating the interior portions of a high dielectric food item, such as a pot pie or fruit pie.

The value of x for total absorption at the proper separation can be represented as the following function of the dielectric constant of the food stuff:

$$x_{opt} = \frac{i\,[|\epsilon_r|^{\frac{1}{2}} + |\epsilon_r|^{-\frac{1}{2}} - 2]^{\frac{1}{2}}}{2} \quad (9)$$

As a result, for food having high dielectric constants, the best film capacitance for impedance matching depends more or less on the fourth root of $|\epsilon_r| - 1$. Therefore, the capacitance is not extremely sensitive to $\epsilon_r$ and a single film can work effectively on a large range of food loads.

EXAMPLE 1

The above-note models were experimentally tested in a microwave oven using a ground terminated, circular waveguide as a receptacle for a water load. The wave guide had a diameter of 8.5 cm and a water level of 3.5 cm. Capacitive films made in accordance with the present invention (x=1.4 i and x=0.8 i) were laminated to paperboard and cut in circles with a diameter of just less than 8.5 cm. The circular capacitive films were placed in the waveguide at various levels above the water, and the temperature rise after 2 minutes in a 650 watt microwave oven was noted. This temperature rise was compared to the temperature rise with a bare board at the same location. The results are set forth below in Tables 1 and 2.

TABLE 1

| | 1.4i Capacitive Film | |
|---|---|---|
| Separation (cm) | Temperature Rise Bare Board (F.°) | Temperature Rise Capacitive (F.°) |
| 1.2 | 5.9 | 13.3 |
| 2.2 | 5.1 | 3.4 |
| 5.0 | 3.8 | 4.2 |

TABLE 2

| | 0.8i Capacitive Film | |
|---|---|---|
| Separation (cm) | Temperature Rise Bare Board (F.°) | Temperature Rise Capacitive (F.°) |
| 1.5 | 6.5 | 14.5 |
| 2.8 | 6.0 | 7.0 |
| 7.5 | 5.4 | 4.6 |

It can be seen that the bare board temperature changes decrease slightly with separation. However, when the capacitive film of the present invention is compared with the bare or naked board, the shorter spacing in each instance increased the heat absorption of the water by better than 2. At the intermediate spacing, as expected, there was no significant effect of the capacitive films.

Avery Dennison Corporation produces aluminum flakes having aspect ratios of at least 1000 which provide the x-values required for the present invention in films of practical thickness. Specifically, the preferred aluminum flakes useful for the present invention are produced by the Decorative Films Division of Avery Dennison Corporation and have the product designations of METALURE TM L-57083, L-55350, L-56903, L-57097, L-57103 and L-57102.

These particular flakes are produced by vacuum vapor depositing a layer of metal on a thin soluble polymeric coating which has been applied to a smooth carrier. Preferably, a biaxially oriented polyester type film is used as the carrier, such as MYLAR TM, a product of Du Pont. The metal layer formed on the carrier is stripped therefrom by dissolving the soluble coating. The preferred vapor deposition thickness for aluminum metal gives an optical density of 1–4 before stripping. This provides a flake having the desired shape and dimensions. If the deposited metal films are too thin, the flakes will not be strong enough to prevent curling upon stripping. On the other hand, if the deposited metal film is too thick, the surface of the film tends to give a rough surface to the flake. Following stripping, the metal layer is then mechanically mixed to provide the desired flake particle size while substantially preventing fragmentation of the flake.

The flakes generally have an average major dimension or length of 8–75 μm with very few fine flakes having a major dimension less than 5 μm. Preferably, the width of the flake falls within the range of 5–35 μm. Fines tend to keep the surfaces of the flakes apart. As measured by a Dapple Image Analyzer, the following is the average length and width dimensions of the above-noted flakes:

TABLE 3

| Product Designation | Average Length μm | Average Width μm |
|---|---|---|
| L-57083 | 8.6 | 5.5 |
| L-55350 | 11.3 | 6.6 |
| L-56903 | 17.2 | 9.7 |
| L-57097 | 22.0 | 10.3 |
| L-57103 | 25.0 | 12.0 |
| L-57102 | 75 | 34.8 |

While the L-57103 and L-57102 flakes are microwave responsive, these flakes are difficult to coat and are not, therefore, the most preferred flake materials for impedance matching. However, these flakes are the preferred flake materials for providing microwave shielding discussed in greater detail below.

The differences between the preferred Avery type flake material and commercially available flake material becomes readily apparent when microscopically viewed. Other commercially available metal flake materials do not have a sufficient aspect ratio and flatness to provide a dielectric constant that is high enough to adequately impedance match, in a thin film, microwave energy entering a food item to evenly heat the center thereof. In order to show this difference, commercially available flake materials were magnified and visually compared with the preferred Avery type flake material to show the distinct differences therebetween.

Figure 5A:
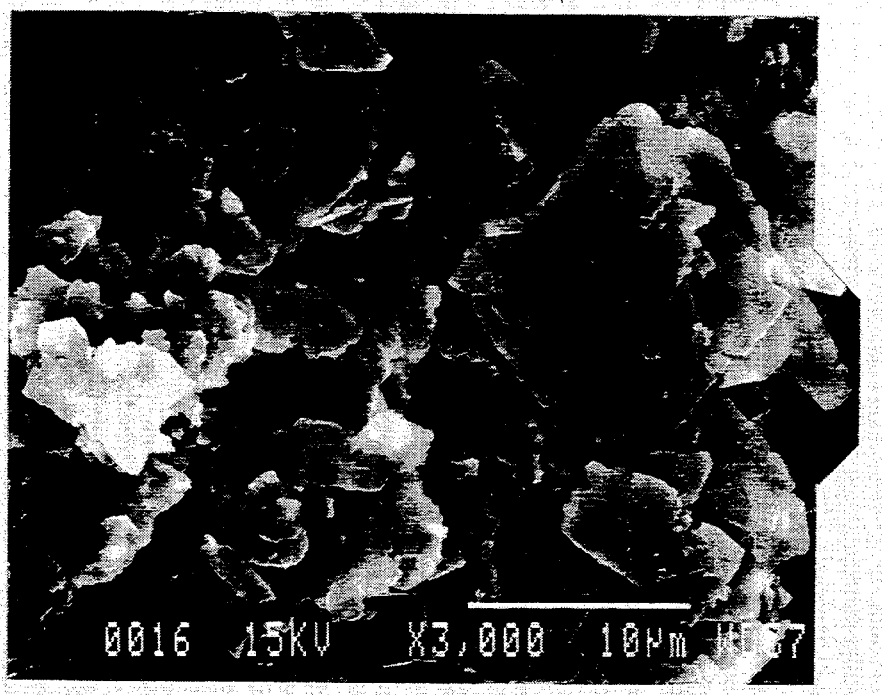
FIGS. 5A–5C and, 6A–6C are enhanced microscopic views of prior art aluminum flakes.
Figure 5B:
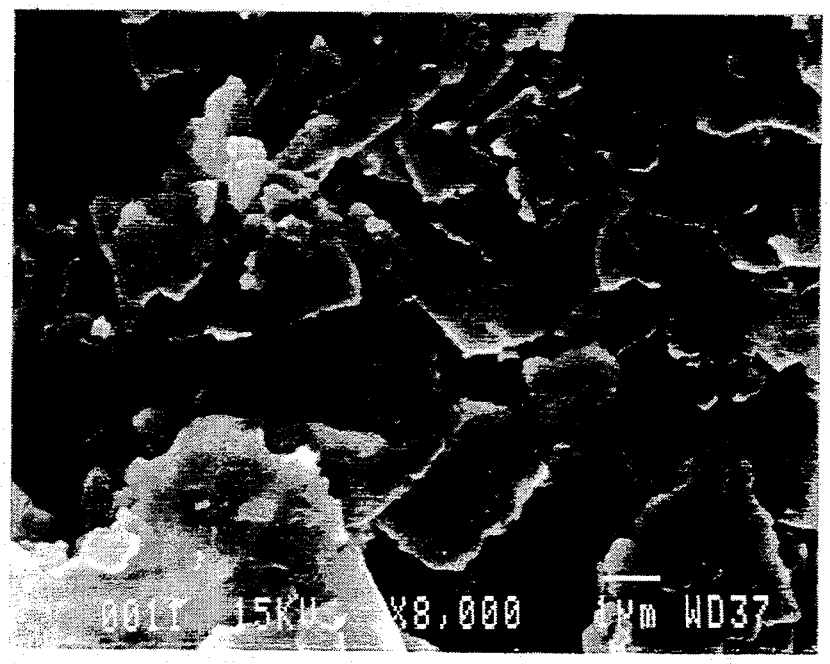
Figure 5C:
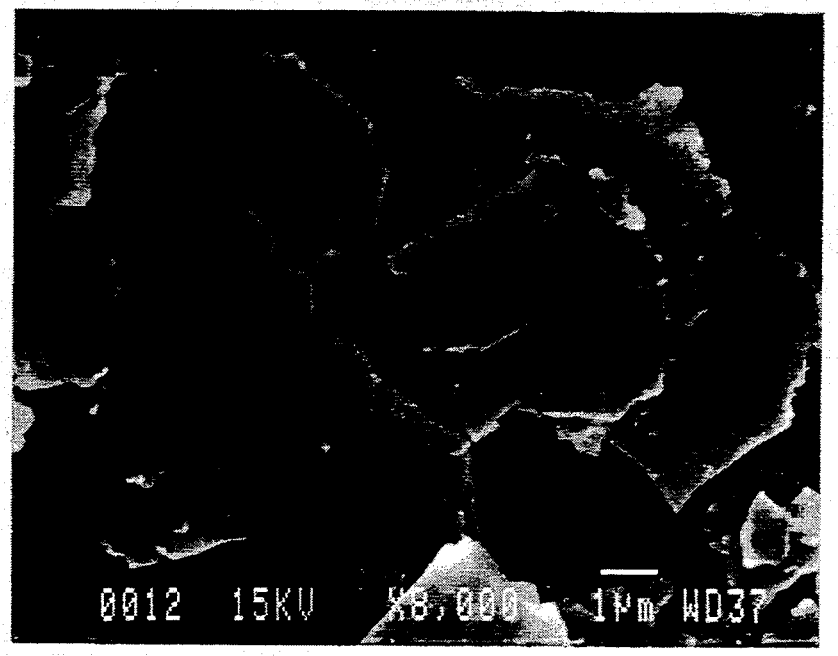
Figure 6A:
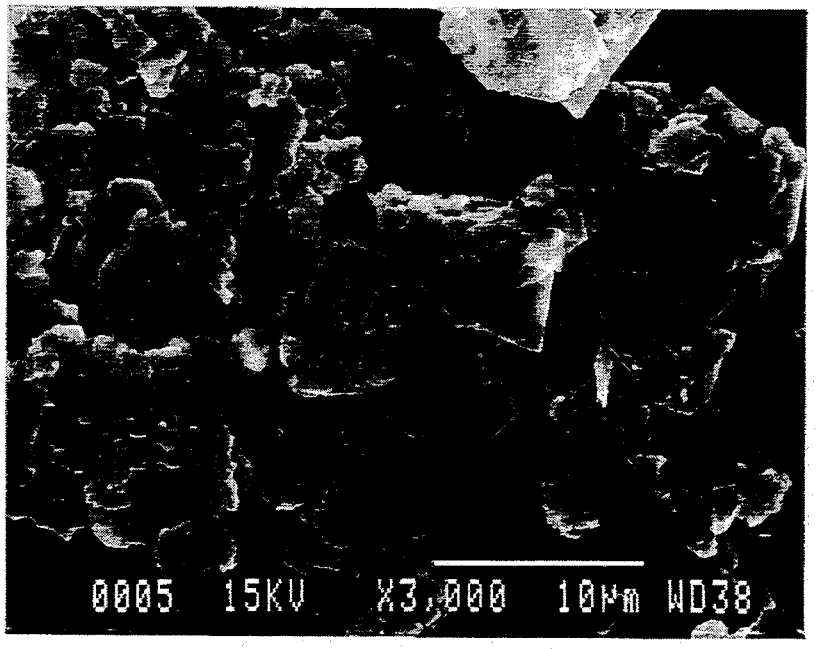
Figure 6B:
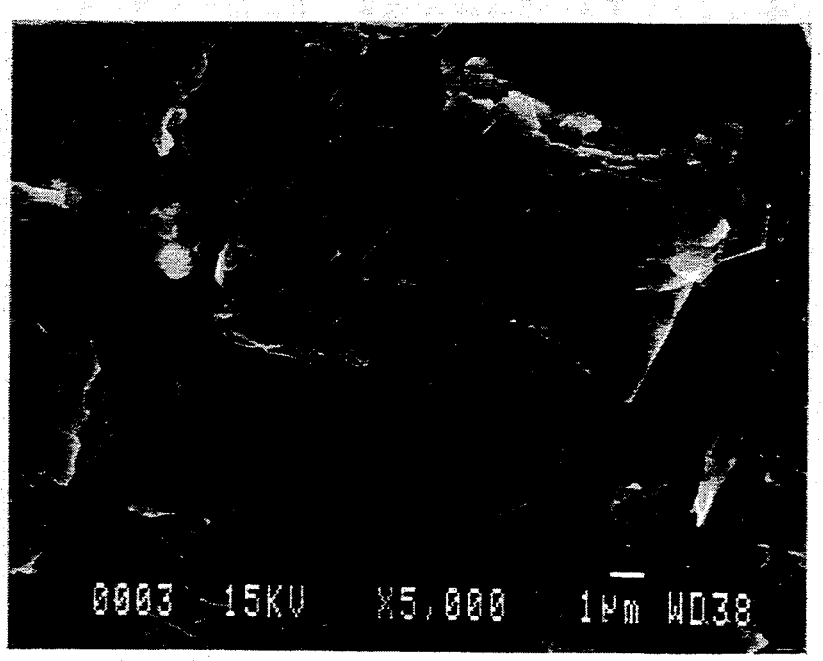
Figure 6C:
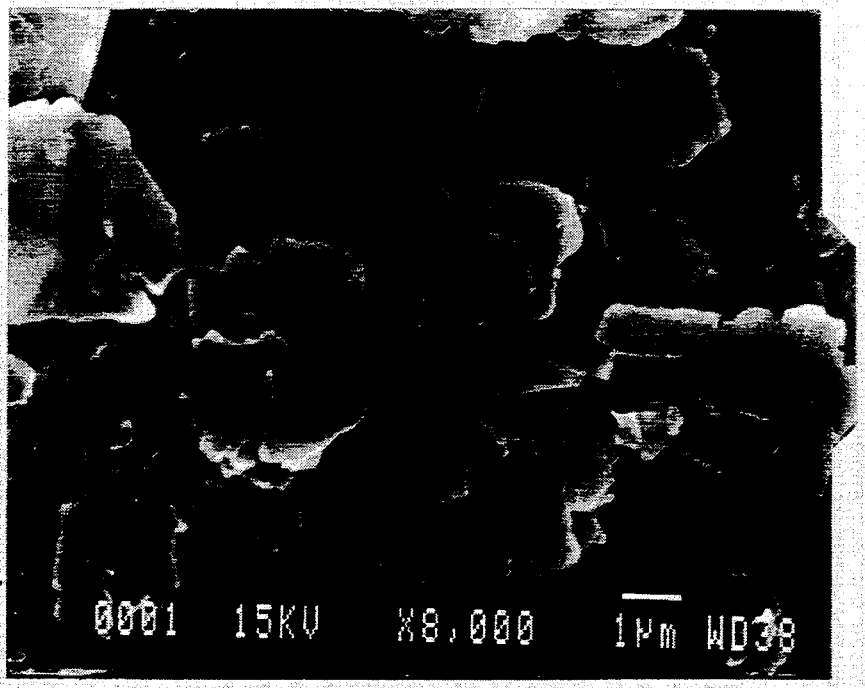

FIGS. 5A–5C show a STAPA-C VIII type aluminum flake produced by Obron Corp., and FIGS. 6A–6C show an ALCAN 5225 type aluminum flake material produced by Alcan. It is clear from these photographs taken at both ×3,000 and ×8,000 that these materials have less surface area than the Avery type flakes shown in FIGS. 4A–4B. This results in an aspect ratio of only 75–80 for the ALCAN 5225 flake and approximately 200 for the STAPA-C VIII flake. The Avery type flake has a large surface area while also being very thin to provide the Avery flake with a higher aspect ratio, and ultimately a higher dielectric constant when immersed in a binder than other aluminum flake materials. Moreover, the Avery flake has rounded and smooth parametric edges, rather, than the rough edges shown by the conventional flake materials and includes less flake fragments.

The aluminum flake material produced by Avery is important to the operation of the impedance matching film of the present invention primarily because of the extremely high dielectric constant provided by these flakes. A performance comparison of the Avery aluminum flake with aluminum flake material produced by other manufacturers clearly illustrates the significant advantages of the Avery type flake material at the same total mass of aluminum. Tests were conducted to the compare the x-values, mathematically described above, of a number of conventional flake materials with one of the Avery flake samples.

EXAMPLE 2

7.78 g of Dow Corning 1-2577 conformal coating (5.6 g of silicone resin solids in toluene) was mixed with 30.3 g of toluene and 1.4 g of Hercules ethylcellulose (T-300 grade which was dissolved in 29.7 g of toluene). A mixture of 10.77 g of Alcan 5225 (an aluminum flake paste at 65% solids in isopropyl alcohol having a particle size of 12–13 μm) and 60 g of ethyl acetate was stirred until a uniform dispersion was obtained and then added to the above binder mixture. The resulting formulation was 10% total solids and had a 50/50 ratio of aluminum flake to binder. Sheets of polyester film (Melinex 813/92 from ICI) were coated with the formulation using a series of Bird film applicators.

A similar formulation was made by premixing 11 g of STAPA-C VIII (aluminum flake paste at 65% solids in isopropyl alcohol having a particle size of 11 μm) with 12.5 g of ethyl acetate until the flake was uniformly dispersed. To this was added 7.8 g of Dow Corning 1-2577 conformal coating (5.6 g of silicone resin solids in toluene), 30.3 g of toluene, and 1.4 g of Hercules ethylcellulose (T-300 grade which was dissolved in 29.7 g of toluene). The resulting formulation was 10% solid and had a 50/50 ratio of aluminum flake to total binder. This formulation was also applied to a polyester sheet film as described above.

A similar mixture was formed using the preferred Avery flake material, L-56903. A 50/50 ratio of aluminum flake to total binder was formed, as described in greater detail below in Example 7. The 2.45 GHz x-values for normally incident radiation ($Z_o$=377 Ohms) were calculated using, for example, Equations (3) and (4), and network analyzer transmission and reflection measurements on samples mounted crosswise in an S-band waveguide. The results of these three sheet materials are shown in FIG. 7 as a function of aluminum coat weight.

Figure 7:
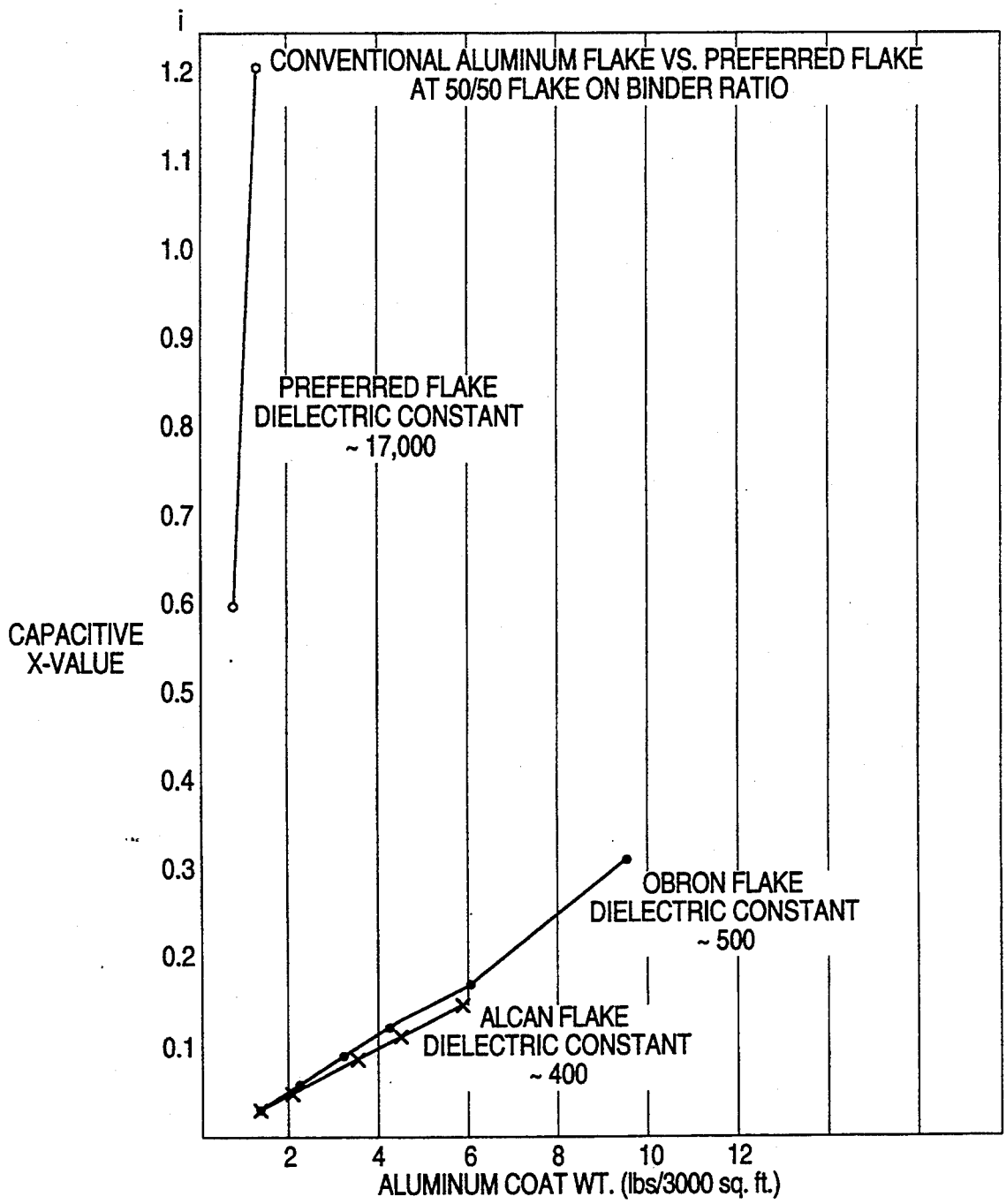
FIGS. 7 and 8 are graphical comparisons of capacitive films including an aluminum flake of the present invention with films including other less effective aluminum flakes.

FIG. 7 clearly shows that the use of these conventional aluminum flake materials, rather than a flake material having the characteristics of the Avery flake, is impractical to achieve the impedance matching ability of the present thin film. Specifically, to reach a desired x-value of 0.7 i–2.0 i, or more preferably, 1.0 i–1.8 i, 20–40 lbs./3000 sq.ft. of conventional flake would be required. Such an extreme amount of flake material would not easily form a thin film. Further, even at this extremely high level, there is no indication that such a large amount of flake material would actually perform the impedance matching function of the present invention.

Additional tests were also conducted to compare the gravure printability of the preferred flake material in both a silicone binder and an acrylic binder with that of a conventional flake material in a silicone binder.

EXAMPLE 3

A coating was made by mixing 5,000 g of toluene with 4,000 g of aluminum flake (Metalure L-56903—10% solids in ethyl acetate). To this was added a mixture of 556 g of Dow Corning 1-2577, which is silicone resin (73% solids in toluene) and 444 g of toluene. The resulting formulation was 8% solids with a 1:1 ratio of aluminum flake and binder solids. The viscosity of the formulation was 22 sec. with a #2 Zahn cup. This formulation was applied to a PET film (grade 813/92 from ICI) on a web fed gravure press at 113 ft./min. using a 100 line cylinder with etched quadrangular cells.

EXAMPLE 4

A coating was made by mixing 3360 g of aluminum flake (Metalure L-56903; 10% solids in ethyl acetate) with 1920 g of n-propyl acetate. To this mixture was added 108 g of Joncryl SCX-611 (an acrylic resin from S. C. Johnson & Sons, Inc.) in 252 g of n-propyl acetate and 36 g of ethylcellulose (grade N-300 from Hercules Inc.) in 324 g of n-propyl acetate. This mixture was diluted to 6% total solids by adding an additional 2,000 g of n-propyl acetate. The viscosity of the resulting mixture was 24 sec. with a #2 Zahn cup. The resulting mixture was applied to a PET film using a gravure press, as described above in Example 3, at 125 ft./min. line speed.

EXAMPLE 5

A coating using conventional aluminum flake material was also made by first mixing 3,200 g of STAPA-C VIII (a 65% solids paste in isopropyl alcohol) with 2,300 g of ethyl acetate and 1,000 g of isopropyl acetate until a uniform dispersion was obtained. To this dispersion was added a mixture of 1,250 g of Dow Corning 1-2577 (72% solids in toluene) and 2,250 g of toluene. The combined formulation was 30% solids and had a viscosity of 17 sec. with a #2 Zahn cup. The resulting mixture was applied to a PET film using a gravure press, as described above in Example 3, at 75–85 ft./min. line speed. The resulting coat weights and x-values at normal radiation at 2.45 GHz for the formulations of Examples 3–5 are provided below in Table 4.

TABLE 4

| Aluminum Flake To Binder Ratio | Number of Passes On Press | Aluminum Coat Wt. Lb./3,000 Sq. Ft. | Capacitive x-Value | Effective Dielectric Constant |
|---|---|---|---|---|
| Avery Al | 1 | 0.3 | 0.34i | 20,000 |
| flake (Ex. 3) | 2 | 0.6 | 1.1i | 32,000 |
| 50/50 | 3 | 0.9 | 1.4i | 27,000 |
| Avery Al | 1 | 0.3 | 1.2i | 130,000 |
| flake (Ex. 4) | 2 | 0.6 | 2.2i | 120,000 |
| 70/30 | 3 | 1.0 | 3.4i | 100,000 |
| Obron Al | 1 | 1.3 | 0.09i | 2,000 |
| flake (Ex. 5) | 2 | 3.0 | 0.20i | 2,000 |
| 70/30 | 3 | 4.8 | 0.31i | 1,900 |
| | 4 | 6.4 | 0.41i | 1,700 |
| | 5 | 8.3 | 0.53i | 1,900 |
| | 6 | 10.1 | 0.63i | 1,700 |

The effect of flake size of the preferred aluminum flake material having the characteristics of the flakes produced by Avery on the x-value is also important in achieving the desired impedance matching characteristics. A number of coating formulations were made using each of the flakes noted above from Avery, Inc., as well as a formulation using the STAPA-C VIII flake from Obron Corp.

EXAMPLE 6

The coating formulation was made by mixing 56 g of aluminum flake slurry (Metalure L-55350), which is 10% solids in ethyl acetate, with 32 g of n-propyl acetate. To this was added 1.8 g of Joncryl SCX-611 (an acrylic resin from S. C. Johnson & Sons, Inc.) in 4.2 g of n-propyl acetate and 0.6 g of ethylcellulose (grade N-300 from Hercules, Inc.) in 5.4 g of n-propyl acetate. This 8% solids formulation, having a 70/30 aluminum flake to binder ratio, was applied to PET film with a Bird bar applicator to obtain the coat weights shown below in Table 5.

Figure 8:
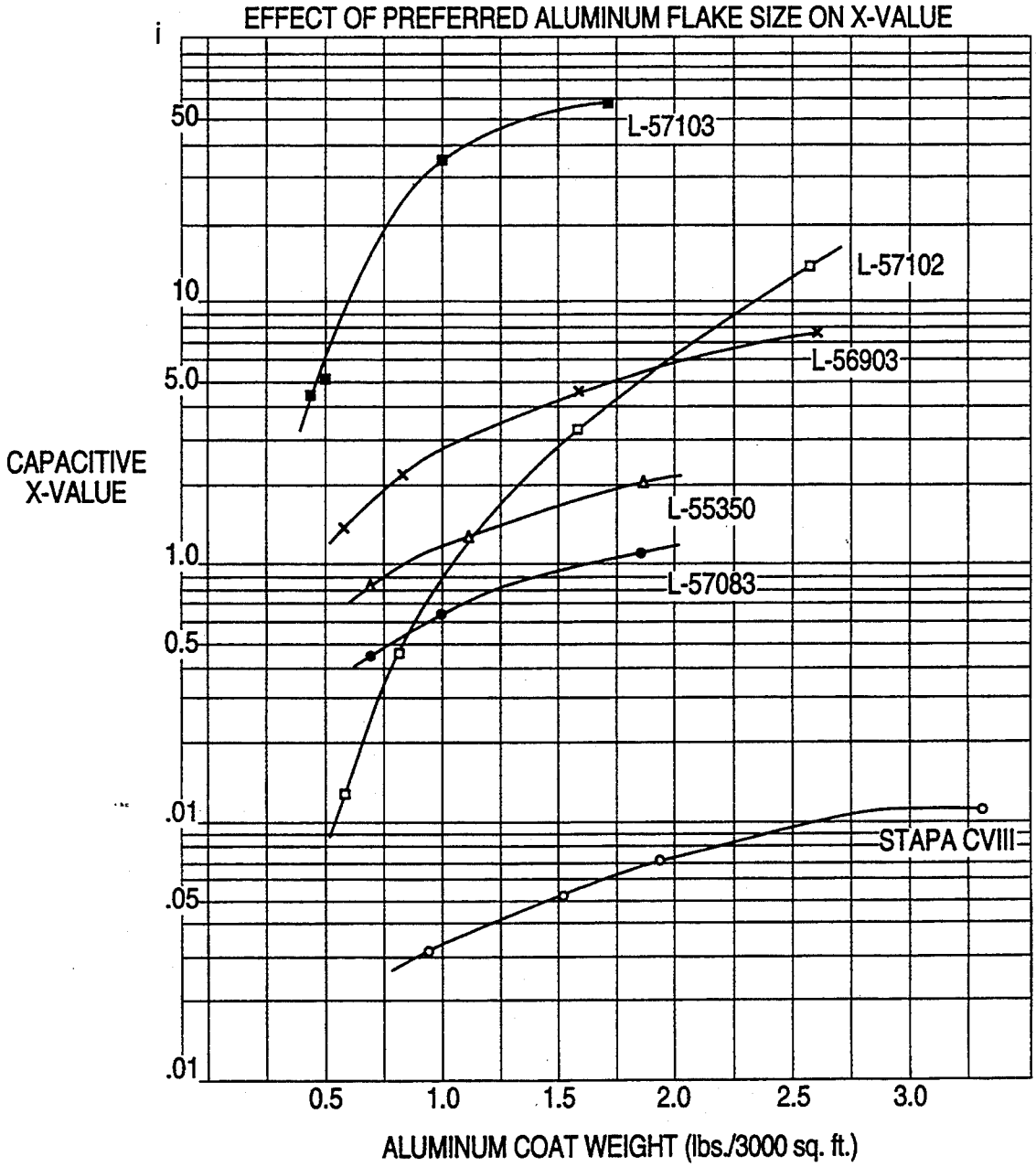

The general procedure was repeated with the following flake materials: L-57083; L-56903; L-57103; L-57102; and STAPA-C VIII. The results of this comparison are provided below in Table 5 and shown graphically in FIG. 8. The results of this comparison show that within the range of flake sizes of the preferred Avery flake, all of which being better than the conventional flake, a flake size of 17 μm provides the consistently best capacitive x-value for impedance matching. The results of Table 5 also illustrate the extreme effective dielectric constant achievable with the present invention, over 18,000, compared to prior materials, only 1,000.

TABLE 5

| Aluminum Flake | Particle Size Avg. Length | Particle Size Avg. Width | Aluminum Coat Wt. Lbs/3000 sq. ft. | Capa. x-value | Effective Dielectric Constant |
|---|---|---|---|---|---|
| L-57083 | 8.6 | 5.5 | 0.7 | 0.43i | 18,000 |
| | | | 1.0 | 0.63i | 19,000 |
| | | | 1.8 | 1.07i | 18,000 |
| L-55350 | 11.3 | 6.6 | 0.7 | 0.81i | 34,000 |
| | | | 1.1 | 1.25i | 34,000 |
| | | | 1.8 | 1.99i | 33,000 |
| L-56903 | 17.2 | 9.7 | 0.6 | 1.41i | 70,000 |
| | | | 0.8 | 2.10i | 78,000 |
| | | | 1.6 | 4.77i | 89,000 |
| | | | 2.6 | 7.56i | 87,000 |
| L-57103 | 25 | 12 | 0.4 | 4.32i | 320,000 |
| | | | 0.5 | 4.94i | 294,000 |
| | | | 1.0 | 35.05i | 1,040,000 |
| | | | 1.7 | 57.67i | 1,010,000 |
| L-57102 | 75 | 34.8 | 0.6 | 0.13i | 6,000 |
| | | | 0.8 | 0.46i | 17,000 |
| | | | 1.6 | 3.30i | 61,000 |
| | | | 2.6 | 10.4i | 119,000 |
| STAPA CVIII | 15 | | 0.9 | 0.03i | 1,000 |
| | | | 1.5 | 0.05i | 1,000 |
| | | | 1.9 | 0.07i | 1,100 |
| | | | 3.3 | 0.11i | 1,000 |

Using the preferred flakes, it is also important to utilize the proper flake to binder ratio to achieve the desired x-value. The following tests were conducted to show the effect of the ratio of aluminum flake material in the binder on the x-value. It is assumed that as the amount of binder in the capacitive film is increased the spacing between the flakes will likewise be increased. Generally, the flakes may comprise about 30–80 percent by weight of the film in order to achieve the advantageous effects of the present invention. Preferably, the flakes are present from about 30–70 percent by weight.

EXAMPLE 7

A master batch of aluminum flake coating utilizing a silicone resin as the primary binder and an ethylcellulose as a thickener and secondary binder was prepared. The master batch contained 4.44 g of Dow Corning 1-2577 conformal coating (3.2 g of silicone resin solids in toluene) and 2.8 g of Hercules ethylcellulose (T-300 grade which was previously dissolved in 59.2 g of toluene). To this mixture, 14 g of aluminum flake solids (L-56903 in ethyl acetate at 10% solids) was added. Thus, the ratio of aluminum flake to binder was 70/30.

(1) 70/30 aluminum flake to binder coatings:

51.5 g of the above master batch, which contains 5 g of combined solids, was diluted to 100 g with toluene. Wet films of this 5% solids formulation were applied to sheets of polyester film (MELINEX 813/92) with Bird film applicators. By using applicators designed to apply 0.0005, 0.001 and 0.002 in. of wet film, it was possible to obtain dried coatings containing 0.4, 0.8 and 1.5 lb/3000 sq. ft., respectively, of aluminum flake solids.

(2) 50/50 aluminum flake to binder coatings:

To 36.8 g of the above master batch (containing 2.5 g of aluminum flake, 0.57 g of silicone resin and 0.50 g of ethylcellulose solids) was added 1.7 g of Dow Corning 1-2577 silicone resin solution (1.23 g solids) and 0.2 g of Hercules ethylcellulose (T-300 grade dissolved in 4.3 g of toluene) and 52 g of toluene to provide a 5% total solids formulation containing 50% aluminum flake and 50% total binder. This formulation was applied to film using the technique described above to obtain dry coating containing 0.7, 1.2 and 2.0 lb./3000 sq. ft. of aluminum flake solids.

(3) 30/70 aluminum flake to hinder coating:

To 22.1 g of the above master batch (containing 1.5 g of aluminum flake, 0.34 g of silicone resin and 0.30 g of ethylcellulose solids) was added 3.4 g of Dow Corning 1-2577 silicone resin solution (2.46 g solids) and 0.4 g of Hercules ethylcellulose (T-300 grade dissolved in 8.5 g of toluene) and 65.6 g of toluene making a 5% total solids formulation containing 30% aluminum flake and 70% total binder. This formulation was applied to film using the above noted technique to obtain dry coatings containing 0.6, 1.0 and 1.3 lb./3000 sq.ft. of aluminum flake solids.

Figure 9:
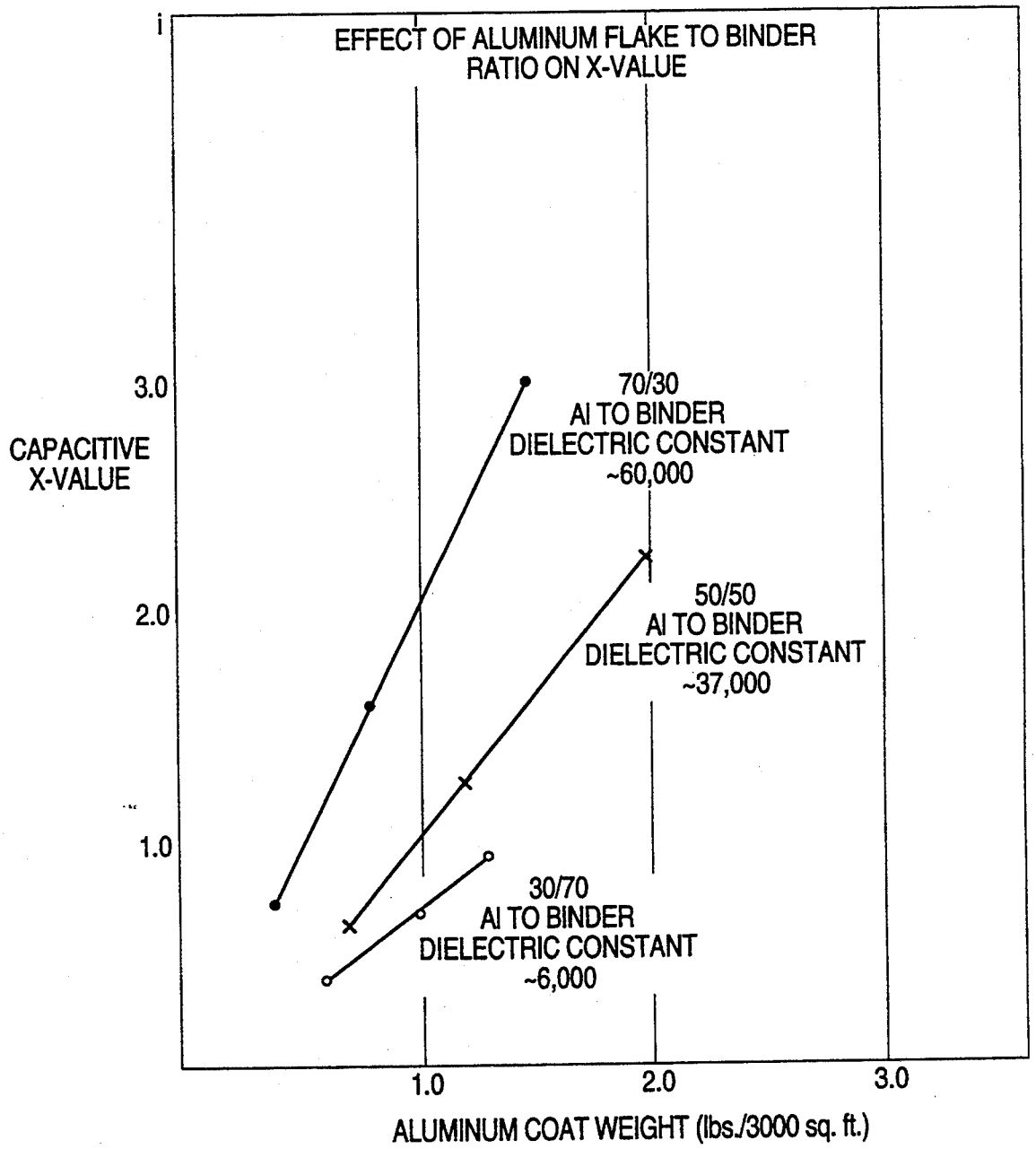
FIG. 9 is a graphical comparison of capacitive film including an aluminum flake of the present invention at different binder to flake ratios.

The x-values for each of the coatings were calculated from measurements made with an S-band waveguide, as discussed above, and a Hewlett Packard network analyzer (Model 8753A). The results are shown in Table 6 below and graphically in FIG. 9. It is readily apparent from these results that as the flake ratio is increased, the x-value per pound of aluminum improves.

TABLE 6

| Aluminum Flake To Binder Ratio | Aluminum Coat Wt. Lbs./3000 Sq. Ft. | Capacitive x-Value | Effective Dielectric Constant |
|---|---|---|---|
| 70/30 | 0.4 | 0.71i | 53,000 |
| | 0.8 | 1.58i | 59,000 |
| | 1.5 | 3.08i | 61,000 |
| 50/50 | 0.7 | 0.61i | 18,000 |
| | 1.2 | 1.24i | 18,000 |
| | 2.0 | 2.24i | 16,000 |
| 30/70 | 0.6 | 0.37i | 5,000 |
| | 1.0 | 0.65i | 6,000 |
| | 1.3 | 0.91i | 6,000 |

A number of additional tests were conducted using actual food samples to demonstrate the enhanced heating provided by the impedance matching member 22 of the present invention. A food carton similar to carton 10 of FIG. 1 was utilized in the following examples.

EXAMPLE 8

An oval shaped impedance matching member 22 was placed $\frac{5}{8}''$ above a Tyson 18 oz Chicken Pot Pie. A control carton was used which was $8\frac{7}{8}''$ wide, $6\frac{1}{8}''$ deep and $1\frac{1}{2}''$ high. The control carton did not include the impedance matching member. A modified carton 10, similar to the carton illustrated in FIG. 1, was $1\frac{7}{8}''$ high. The oval impedance matching member 22 was $3\frac{1}{2}''$ by $2\frac{7}{8}''$ wherein x=1.01 i. Each of the runs involved heating the pot pie for 5 minutes, rotating the pot pie 90° and then heating the pot pie for another 5 minutes.

Figure 10:
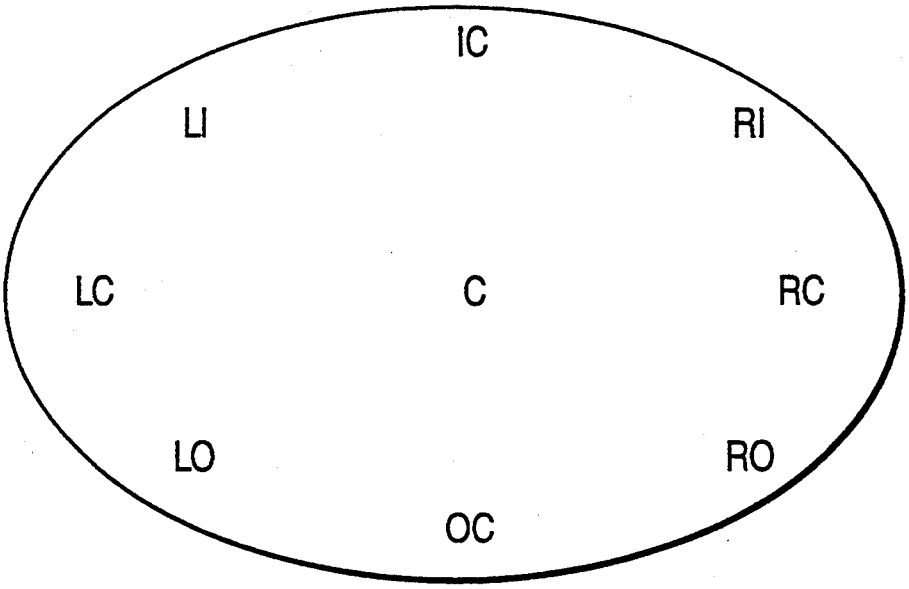
FIG. 10 illustrates the temperature probe positions within a sample food item used in the examples provided below.

Four cooking runs were performed wherein the pot pie was cooked without a box (#1), in the control box (#2), in a box having the whole inside surface covered with impedance matching member 22 (#3), and in a box including the oval shaped member 22 placed on the top panel as shown in FIG. 1 (#4). Temperature probes were placed in the pot pie in the positions shown in FIG. 10. The results of these runs are shown below in Table 7.

TABLE 7

| | Temperature (°F.) | | | |
|---|---|---|---|---|
| Position | #1 | #2 | #3 | #4 |
| C | 91 | 95 | 70 | 153 |
| LI | 194 | 200 | 192 | 195 |
| IC | 190 | 192 | 180 | 186 |
| RI | 197 | 198 | 193 | 182 |
| LC | 200 | 200 | 195 | 199 |
| RC | 193 | 187 | 185 | 188 |
| LO | 192 | 193 | 192 | 193 |
| OC | 185 | 184 | 192 | 183 |
| RO | 186 | 188 | 179 | 190 |

EXAMPLE 9

Another series of tests were run to compare a control carton having no impedance matching member (#5), a rectangular shaped (#6) impedance matching member $3\frac{1}{2}''\times3''$ and the oval shaped (#7) impedance matching member 22 from above wherein x=0.8 i. A pot pie was cooked as noted above in Example 8 in each of the cartons, and the results of these runs are shown below in Table 8.

TABLE 8

| | Temperature (°F.) | | |
|---|---|---|---|
| Position | #5 | #6 | #7 |
| C | 94 | 117 | 155 |
| LI | 195 | 198 | 190 |
| IC | 192 | 192 | 197 |
| RI | 186 | 190 | 198 |
| LC | 199 | 193 | 192 |
| RC | 182 | 183 | 186 |
| LO | 186 | 185 | 186 |
| OC | 188 | 189 | 188 |
| RO | 180 | 187 | 190 |

EXAMPLE 10

A test (#8) was also run using a conventional piece of aluminum foil in the same oval configuration provided above with respect to impedance matching member 22 used above in Examples 8 and 9. The aluminum foil oval was elevated $\frac{3}{8}''$ above a Tyson 18 oz Pot Pie.

EXAMPLE 11

A test (#9) was conducted using an impedance matching member 22 with a thickness twice that of the impedance matching members noted above (x=1.3 i+0.8 i) and the same oval configuration provided above.

EXAMPLE 12

A test (#10) was conducted using an enlarged oval impedance matching member 22 having the dimensions of $4''\times4\frac{1}{2}''$ wherein x=1.3. Other conditions were the same as above.

EXAMPLE 13

The distance the impedance matching member 22 having the $3''\times3\frac{1}{2}''$ oval dimensions was also adjusted to determine center pie heating (#11). Particularly, the member was placed on the inside top surface of the carton $\frac{1}{2}''$ over the surface of the pie. The results of Examples 10–13 are provided below in Table 9.

TABLE 9

| | Temperature (°F.) | | | |
|---|---|---|---|---|
| Position | #8 | #9 | #10 | #11 |
| C | 64 | 123 | 120 | 155 |
| LI | 190 | 195 | 198 | 192 |
| IC | 192 | 185 | 197 | 188 |
| RI | 192 | 182 | 192 | 180 |
| LC | 193 | 197 | 198 | 180 |
| RC | 184 | 182 | 191 | 180 |
| LO | 187 | 186 | 193 | 187 |
| OC | 188 | 194 | 195 | 185 |
| RO | 182 | 184 | 192 | 185 |

EXAMPLE 14

The dimensions of carton 10 and member 22 were also adjusted to optimize the degree of heating in the center of the pot pie (#12). For example, an open ended carton or sleeve having a length of 9", a width of 6" and a height of $2\frac{1}{4}''$ was used to heat a Tyson 18 oz Chicken Pot Pie. The pot pie was resting on three layers of corrugated paper, and the distance between the pie and the impedance matching member was $\frac{5}{8}''$. The larger oval impedance matching member was used which was $4\frac{1}{2}''\times4''$ with x=1.1 i.

EXAMPLE 15

A test (#13) similar to Example 8 was conducted utilizing the same cooking sleeve. However, the oval impedance matching member dimensions were reduced to $2''\times1\frac{3}{4}''$ with x=1.1 i.

EXAMPLE 16

Two additional tests (#14 and #15) similar to Examples 8 and 9 were conducted utilizing the same cooking sleeve. However, the oval impedance matching member dimensions were $2\frac{1}{2}''\times2''$ with x=1.1 i.

EXAMPLE 17

Finally, a control test (#16) was run with a pot pie similar to that used in Examples 14–16. However, the pot pie was cooked without a carton. The results of Examples 14–17 are provided in Table 10 below.

TABLE 10

| Position | Temperature (°F.) #12 | #13 | #14 | #15 | #16 |
|---|---|---|---|---|---|
| C | 185 | 147 | 155 | 182 | 79 |
| LI | 175 | 190 | 190 | 190 | 193 |
| IC | 170 | 188 | 181 | 192 | 179 |
| RI | 187 | 183 | 183 | 189 | 182 |
| LC | 176 | 196 | 196 | 197 | 192 |
| RC | 176 | 175 | 173 | 184 | 176 |
| LO | 171 | 187 | 186 | 188 | 186 |
| OC | 185 | 191 | 180 | 189 | 166 |
| RO | — | 193 | 184 | 192 | 181 |

Cartons were also tested to determine an optimum size for a rectangular or square impedance matching member which elevates the temperature of a pot pie similar to the advantageous heating provided by the oval design. A series of tests were run on a Tyson 18 oz Chicken Pot Pie using a carton similar to the carton used above in Examples 14–17 having a carton depth of 1⅝", but replacing the oval impedance matching member with a rectangular member 2½"×2". Table 11 provides the results of three different tests run with the rectangular member (#17, #18, #19, #20). A control test was also run without a carton (#21).

TABLE 11

| Position | Temperature (°F.) #17 | #18 | #19 | #20 | #21 |
|---|---|---|---|---|---|
| C | 152 | 162 | 160 | 187 | 127 |
| LI | 199 | 186 | 187 | 198 | 194 |
| IC | 185 | 186 | 174 | 191 | 195 |
| RI | 191 | 191 | 177 | 188 | 190 |
| LC | 195 | 192 | 183 | 195 | 188 |
| RC | 178 | 189 | 162 | 188 | 189 |
| LO | 186 | 185 | 156 | 188 | 187 |
| OC | 191 | 183 | 178 | 193 | 186 |
| RO | 189 | 171 | 171 | 195 | 188 |

As can be seen in each of the results noted above, substantially increased center temperatures for the pot pie were achieved using the impedance matching member of the present invention.

The impedance matching member of the present invention may also be useful for altering the relative cooking rates and temperatures of two different items. Such a result may be very effective in complete microwave dinners that include a variety of different foods, each requiring different heating characteristics. For example, the meat portion of a complete dinner may require higher heating temperatures than the vegetable portion. However, to provide the consumer with added convenience, these items are commonly provided in the same packaging tray. The use of the impedance matching member of the present invention for one portion of the tray and not another can cause dramatic differences in temperature.

EXAMPLE 18

Two beakers of water were placed in a 600 watt microwave oven at the same time, one of the beakers on the left side of the oven and one on the right side. Average power absorption from room temperature to boiling was calculated for each beaker. Data was taken for all possible combinations: no impedance matching; left impedance matched, right unmatched; left unmatched, right impedance matched; and both impedance matched. Experiments were conducted for both 100 mL water loads and 400 mL water loads. The results are set forth in Table 12 below.

TABLE 12

| Water load (mL) | Average Power Absorption (W) left naked | right naked | left match | right naked | left naked | right match | left match | right match |
|---|---|---|---|---|---|---|---|---|
| 100 | 252 | 257 | 346 | 190 | 190 | 323 | 260 | 257 |
| 400 | 270 | 285 | 365 | 208 | 218 | 350 | 291 | 279 |

The impedance matched sections of the oven contents heated faster than unmatched sections. However, impedance matching the total contents did not increase the total oven output. Partial impedance matching generally redistributes the heating in the oven.

Figure 11:
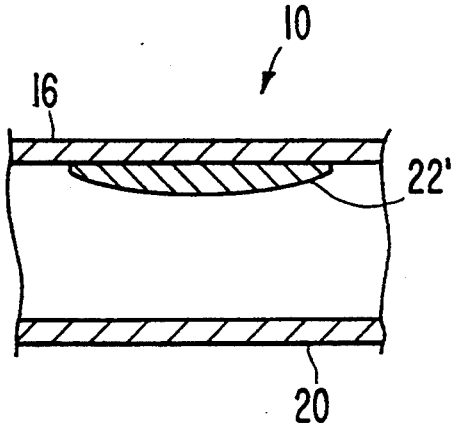
FIG. 11 is an exploded cross-sectional side view of a second embodiment of the microwave impedance matching element of the present invention.

In addition to uniform impedance matching members used for impedance matching radiation into hard to heat regions of a food item, the impedance matching member of the present invention may also be configured in a nonuniform nature to function in a microwave oven similar to a convex glass lens. FIG. 11 illustrates an example of a modified impedance matching member 22' within package 10 which is configured similar to a convex optical lens. Such a configuration is useful to further direct microwave radiation to desired areas of package 10.

As noted above, the transmission coefficient, T, is a complex number. Therefore, there will be a phase shift through the film represented as:

$$\Phi = -\tan^{-1}x \tag{10}$$

If an impedance matching member of the present invention is printed such that the center is thicker than the edges, a decreasing phase shift would be created approaching the periphery of the member. As a result, radiation in the microwave could be focused similar to light through a convex optical lens.

Specifically, as in optical lenses, the focal condition occurs due to the phase shift at the center equalling the extra shift due to the larger path depth at the edge, or:

$$\tan^{-1}x = 2\pi|(h^2+L^2)^{\frac{1}{2}}-1]/\lambda \tag{11}$$

where h is half height of the lens, L is the focal length, and λ is the wavelength of the radiation. To realize the best lens shape, the lens x-value as a function of y (the distance from the center of a lens), formed in accordance with the present invention, the following equation applies:

$$x(y) = \tan\{2\pi|(h^2+L^2)^{\frac{1}{2}}-1]/\lambda\} - \tan\{2\pi[(y^2+L^2)^{\frac{1}{2}}-1]/\lambda\} \tag{12}$$

In addition to the above-noted advantages of impedance matching, if the x-values of the films are high enough, the film can also act as a shield. Specifically, if the x-value is higher than 10 i, for example, the film may function as a shield to reduce the amount of microwave energy reaching a food item placed below the film. For normally incident radiation, the ratio of the electric field amplitude entering a dielectric food stuff with a capacitive film shield at the surface to the field entering without such a shield can be represented as:

$$\frac{1+\epsilon^{\frac{1}{2}}}{1+2x+\epsilon^{\frac{1}{2}}} \quad (13)$$

where $\epsilon$ is the effective dielectric constant. As evidenced by this relationship, the level of capacitive film depends on the dielectric constant. For typical food stuff having a dielectric constant of 50, the capacitive x-value should be at least 10 i. Table 5 provides an example of a flake material and coat weight capable of providing shielding. Specifically, the L-57103 flake, having an average length of 25 μm and a coat weight of 1.0–1.7 lbs/3000 sq.ft.

EXAMPLE 19

Tests were conducted to demonstrate the usefulness of a high x value capacitive film for shielding foods in a microwave oven. Specifically, two paper cups containing 120 g of water were each placed in a 700 watt Litton microwave oven. First, each cup of water having no flaked material introduced in the cup was heated in a 700 watt LITTON TM microwave oven until one reached about 200° F. The temperature in each cup was monitored by two Luxtron probes suspended at fixed, reproducible positions in the water. The average heat dissipation in watts was calculated for each cup of water from the average temperature rise and heating time. Next, aluminum foil patches were glued on the bottom and the sides of one of the cups designated at cup B. Again, the average power dissipation was calculated. This procedure was conducted two more times by replacing the aluminum foil patches with a capacitive film having an x-value of 1.5 i and 20 i, respectively. The results are set forth in Table 13 below.

TABLE 13

| Cup | Test 1 | Test 2 (aluminumfoil) | Test 3 (x = 1.5i) | Test 4 (x = 20i) |
|---|---|---|---|---|
| A | 222 W | 273 W | 220 W | 275 W |
| B | 246 W | 137 W | 238 W | 169 W |

As can be seen by these results, the 1.5 i film had little influence on the power dissipation when placed at the surface of the container. However, the aluminum foil provides significant shielding illustrated by the reduction of power dissipation in cup B in Test 2. Test 4 illustrates that a 20 i film also provides shielding and also demonstrates that, by using capacitive films made in accordance with the present invention, the amount of shielding can be controlled by adjusting the x-value of the film.

The foregoing is considered as illustrative only of the principles of the invention. Further, since numerous modifications and changes will readily occur to those of skill in the art, it is not desired to limit the invention to the exact construction shown and described. Accordingly, all suitable modifications and equivalents may fall within the scope of the invention.

We claim:

1. A package for storing and microwave heating food comprising:

(a) a package body substantially transparent to microwave energy forming a food receiving cavity including a bottom panel and a top panel with side panels joining said bottom panel with said top panel; and (b) impedance matching means provided on a surface of at least one of said bottom panel, top panel and side panels for impedance matching microwave energy entering the package, said impedance matching means comprising a contiguous film of flakes embedded in a dielectric binder wherein said impedance matching means is sized and spaced with respect to the food to cause impedance matching to elevate the temperature of the food by increasing the amount of microwave energy directed to the food in at least a predetermined area thereof dependent upon the size and spacing of said film without interacting with the microwave energy to produce heat.

2. The package of claim 1, wherein said flakes are generally planar and comprise aluminum metal having a longest average dimension within the range of about 8–75 micrometers 3. The package of claim 2, wherein said flakes have an aspect ratio of at least about 1,000.

4. The package of claim 2, wherein said impedance matching means has an effective dielectric constant of at least 4,000.

5. The package of claim 4, wherein said flake has a capacitive x-value within the range of about 0.7 i–2.0 i.

6. The package of claim 5, wherein said flakes are present at a coat weight within the range of about 0.30–2.6 lb./3000 sq. ft.

7. The package of claim 6, wherein said flakes are present at a coat weight within the range of about 0.30–1.8 lb./3000 sq.ft.

8. The package of claim 6, wherein said flakes comprise about 30–70 percent by weight of the film.

9. The package of claim 8, wherein said flakes comprise 70 percent by weight of the film.

10. The package of claim 4, wherein said flakes are present at a coat weight within the range of about 0.30–2.6 lb./3000 sq.ft.

11. The package of claim 10, wherein said flakes are present at a coat weight within the range of about 0.30–1.8 lb./3000 sq.ft.

12. The package of claim 4, wherein said flake has a thickness within the range of about 100–500 Å.

13. The package of claim 12, wherein said flake has a thickness within the range of about 100–200 Å.

14. The package of claim 4, wherein said surface of at least one of said bottom panel, top panel and side panels comprises paper or paperboard.

15. The package of claim 14, wherein said impedance matching means is positioned on said top panel above the food.

16. The package of claim 15, wherein said impedance matching means is positioned about ⅛" to ⅝" above said food.

17. The package of claim 16, wherein said impedance matching means is diametrically smaller than the food held within said package.

18. The package of claim 17, wherein said impedance matching means is oval shaped.

19. The package of claim 2, wherein said flake is formed by the steps of:

(a) vapor depositing a layer of aluminum metal on a soluble polymeric coating applied to a carrier; and (b) stripping the layer from the carrier.

20. The package of claim 19, wherein the layer of aluminum metal has an optical density within the range of about 1 to 4.

21. A package for storing and microwave heating food comprising:

(a) a package body substantially transparent to microwave energy forming a food receiving cavity including a bottom panel and a top panel with side panels joining said bottom panel with said top panel; and (b) impedance matching means provided on an extended surface of at least one of said panels for impedance matching microwave energy entering the package, wherein said impedance matching means is convex such that the center thereof has a thickness greater than the thickness at the periphery thereof to focus impedance matched microwave energy toward the food to elevate the temperature of the food by increasing the amount of microwave energy directed to the food in an area corresponding to the size of the impedance matching means and spacing of said impedance matching means from the food without interacting with the microwave energy to produce heat wherein said impedance matching means comprises a continuous film of generally planar flakes embedded in a dielectric binder.

22. The package of claim 21, wherein said impedance matching means is positioned on said top panel above said food.

23. The package of claim 22, wherein said flakes comprise aluminum having a longest average dimension within the range of about 8–75 micrometers.

24. The package of claim 23, wherein said flakes have an aspect ratio of at least about 1,000.

25. The package of claim 23, wherein said impedance matching means has a dielectric constant of at least about 4,000.

26. The package of claim 23, wherein said flake is formed by the steps of:

(a) vapor depositing a layer of aluminum metal on a soluble polymeric coating applied to a carrier; and (b) stripping the layer from the carrier.

27. The package of claim 26, wherein the layer of aluminum metal has an optical density within the range of about 1 to 4.

28. The package of claim 27, wherein said impedance matching means is diametrically smaller than the food held within said package.

29. A composite material for impedance matching microwave energy without interacting with the microwave energy to produce heat comprising:

(a) a substrate substantially transparent to microwave energy; and (b) impedance matching means provided on at least a portion of the substrate for impedance matching microwave energy, said impedance matching means comprising a contiguous film of generally planar flakes embedded in a dielectric binder wherein said flakes comprise aluminum having a longest average dimension within the range of about 8–75 micrometers and a thickness within the range of about 100–500 Å.

30. The composite material of claim 29, wherein said flakes have an aspect ratio of at least about 1,000.

31. The composite material of claim 29, wherein said impedance matching means has a dielectric constant of at least about 4,000.

32. The composite material of claim 31, wherein said flakes have a capacitive x-value within the range of about 0.7 i–2.0 i.

33. The composite material of claim 32, wherein said flakes are present at a coat weight within the range of 0.30–2.6 lb./3000 sq.ft.

34. The composite material of claim 33, wherein said flakes are present at a coat weight within the range of 0.30–1.8 lb./3000 sq.ft.

35. The composite material of claim 33, wherein said flakes have a thickness within the range of about 100–200 Å.

36. The composite material of claim 33, wherein said flakes comprise about 30–70 percent by weight of the film.

37. The composite material of claim 36, wherein said flakes comprise 70 percent by weight of the film.

38. The composite material of claim 36, wherein said substrate is paper, paperboard, or plastic film.

39. The composite material of claim 33, wherein said flake is formed by the steps of:

(a) vapor depositing a layer of aluminum metal on a soluble polymeric coating applied to a carrier; and (b) stripping the layer from the carrier.

40. The composite material of claim 39, wherein the layer of aluminum metal has an optical density within the range of about 1 to 4.

41. A composite material for shielding a food item from microwave energy positioned proximate thereto comprising:

(a) a substrate substantially transparent to microwave energy; and (b) a shielding means provided on at least a portion of the substrate for reducing the amount of microwave energy reaching a food item positioned proximate thereto, said shielding means comprising a contiguous film of generally planar flakes embedded in a dielectric binder in an amount sufficient to reduce microwave energy reaching the food item when said composite material is positioned proximate thereto wherein said flakes comprise aluminum having a longest average dimension within the range of about 8–75 micrometers and a thickness within the range of about 100–500 Å.

42. The composite material of claim 41, wherein a capacitive x-value of said composite material is greater than 10 i.

43. The composite material of claim 42, wherein said flakes are present in said binder in the range of about 1.0–1.7 lbs/3000 sq.ft.

44. The composite material of claim 43, wherein an effective dielectric constant of said shielding means is at least about 100,000.

45. The composite material of claim 44, wherein said flakes have an aspect ratio of at least about 1,000.

46. A package for storing and microwave heating food comprising:

(a) a package body substantially transparent to microwave energy forming a food receiving cavity including a bottom panel and a top panel with side panels joining said bottom panel with said top panel; and (b) impedance matching means provided on a surface of at least one of said bottom panel, top panel and side panels for impedance matching microwave energy entering the package, said impedance matching means comprising a contiguous film of flakes embedded in a dielectric binder wherein said impedance matching means is sized and spaced with respect to the food to cause impedance matching to elevate the temperature of the food by increasing the amount of microwave energy directed to the food in at least a predetermined area thereof dependent upon the size and spacing of said film, wherein said flakes are generally planar having a longest average dimension within the range of about 8–75 micrometers and a thickness within the range of about 100–500 Å.

* * * * *